US005944139A

United States Patent [19]

Kozial

[11] Patent Number: 5,944,139

[45] Date of Patent: Aug. 31, 1999

[54] LUMINATED CLIMBING DEVICE FOR TREES AND THE LIKE

[76] Inventor: Joseph R. Kozial, 1100 Randville, Unit 10, Palatine, Ill. 60067

[21] Appl. No.: 08/810,660

[22] Filed: Mar. 3, 1997

[51] Int. Cl.[6] ..... E04G 3/00

[52] U.S. Cl. ..... 182/92; 182/90

[58] Field of Search ..... 182/90, 92, 129, 182/221; 250/462.1; 362/84, 253

[56] References Cited

U.S. PATENT DOCUMENTS

| | | | |
|---|---|---|---|
| D. 297,169 | 8/1988 | Trani, Sr. . | |
| D. 303,155 | 8/1989 | Ayers . | |
| 3,090,489 | 5/1963 | Smith | 362/253 X |
| 3,298,459 | 1/1967 | Bergsten . | |
| 3,380,697 | 4/1968 | Melcher . | |
| 4,000,788 | 1/1977 | Burgess et al. . | |
| 4,027,742 | 6/1977 | House, Jr. . | |
| 4,109,761 | 8/1978 | Matlock . | |
| 4,311,208 | 1/1982 | Macrorie et al. | 182/129 X |
| 4,360,557 | 11/1982 | Miller | 428/142 |
| 4,415,061 | 11/1983 | Meyer . | |
| 4,522,861 | 6/1985 | Dunsworth | 428/192 |
| 4,523,259 | 6/1985 | Dorsett et al. | 362/253 X |
| 4,697,669 | 10/1987 | Bergsten . | |
| 4,775,030 | 10/1988 | Wright . | |
| 4,867,272 | 9/1989 | Troubridge . | |
| 5,008,551 | 4/1991 | Randolph | 250/462.1 |
| 5,086,377 | 2/1992 | Roberts | 362/253 X |
| 5,086,873 | 2/1992 | George . | |
| 5,244,058 | 9/1993 | Carson et al. . | |
| 5,279,388 | 1/1994 | Laughlin et al. . | |
| 5,318,177 | 6/1994 | Isacson | 362/253 X |
| 5,539,627 | 7/1996 | Foster | 362/253 |
| 5,611,615 | 3/1997 | Jang | 362/253 X |

*Primary Examiner*—Daniel P. Stodola
*Assistant Examiner*—Richard M. Smith
*Attorney, Agent, or Firm*—Meroni & Meroni; Charles F. Meroni, Jr.

[57] ABSTRACT

A tree step for climbing a vertical structure such as a tree and a pole in a relatively enlightened environment and then descending the vertical structure in a relatively darkened environment. The tree step comprising an attaching structure. A surface engageable portion connected to the attaching structure. A step connected to the surface engageable portion. The step having an outer end with an upwardly facing surface. A luminescent member for radiating light upwardly from the upwardly facing surface only in a substantially vertical direction. A semi-rigid, semi-transparent cover structure protecting the luminescent member from an outside environment.

20 Claims, 2 Drawing Sheets

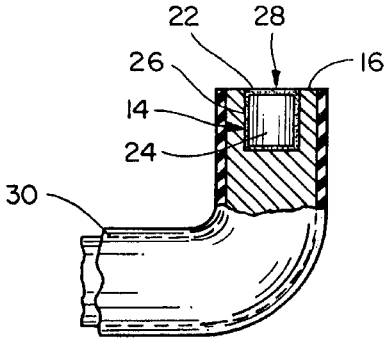
Fig. 4
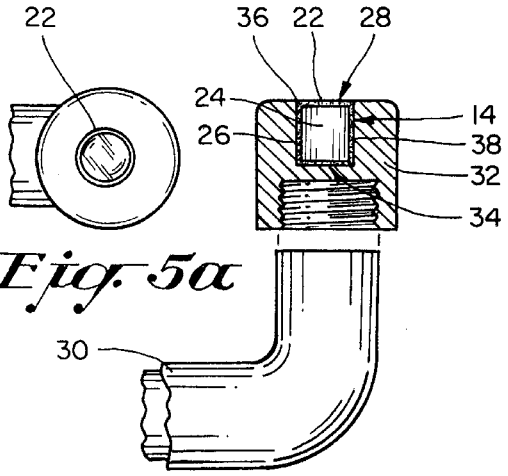
Fig. 5a
Fig. 5
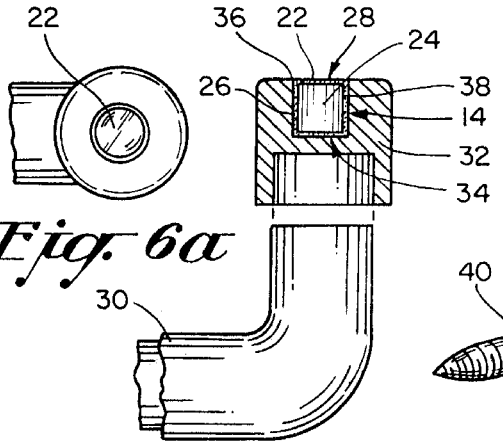
Fig. 6a
Fig. 6
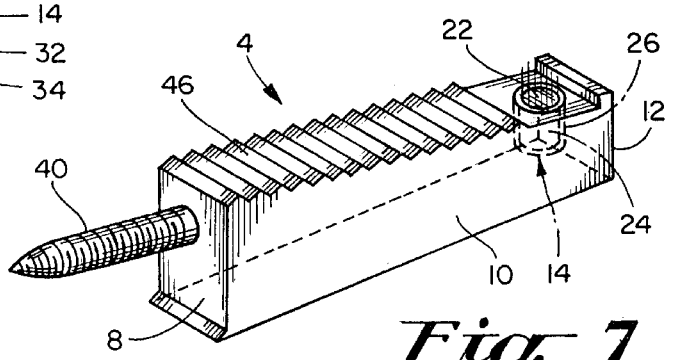
Fig. 7
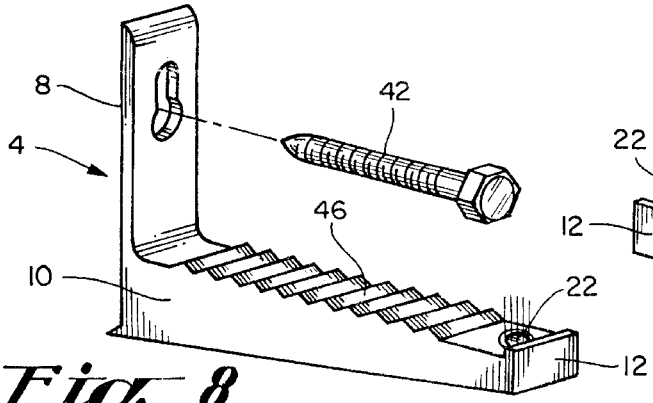
Fig. 8
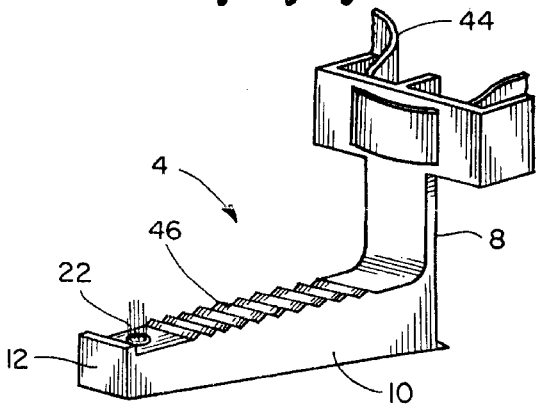
Fig. 9

LUMINATED CLIMBING DEVICE FOR TREES AND THE LIKE

BACKGROUND OF THE INVENTION

1. Field of the Invention

The present invention relates generally to a device commonly known as a tree step. More specifically, the present invention relates to improvements in a tree step device whereby the tree step is controllably luminated for use at remote locations and specifically for use in relatively darkened conditions in such places as wooded areas commonly frequented to hunt animals.

2. Description of the Prior Art

There is an abundance of tree step like devices in the prior art for use in climbing trees and poles and the like. A few patents that are representative of such devices include U.S. Pat. Nos. Tree Climber or Step Device, 5,279,388; Tree Step, 5,086,873; Steps for Climbing Trees, 4,867,272; Tree Step, 4,775,030; Folding Portable Tree Step, 4,697,669; Portable Tree Climbing Device, 4,415,061; Portable Climbing Device, 4,109,761; Cleat For Climbing Trees And The Like, 4,027,742; Belt-On Tree Step (Bots), 4,000,788; Portable Steps For Climbing Trees or Poles, 3,380,697; Tree Climbing Apparatus, 3,298,459; Tree Step, Des.303,155; and, Tree Step, Des.297,169.

A tree step is commonly used to aid an individual in climbing a tree or pole like structure where the tree step is some how attached to the tree by a screw/bolt/nail like structure or a belt like structure, where this structure is either integrally connected to the tree step or removably connected to the tree step. The tree step is commonly used in place of or in conjunction with existing tree branches to aid the individual user in climbing and descending the tree, which tree is usually located at a remote location not accessible to a commercial power supply or line. In operation multiple tree step devices are selectively attached to the tree to aid the individual in climbing up the tree.

One group of individuals largely responsible for utilizing the tree step devices are hunters and in particular bow hunters. In the art of bow hunting it is preferable to hunt for animals from an aerial location (such as up a tree or pole like structure) at dusk. In order to hunt under these ideal conditions, the hunter must climb a tree just prior to dusk, hunting while it gets dark and thus remaining up in the tree until after it gets dark. Then, when it is relatively dark and the hunter wants to get out of the tree, he must try and traverse his way down the tree blindly locating the tree steps attached to the tree, primarily relying on the feel of touch to do so. Additionally, to most safely climb out of the tree the hunter must use both hands to carry his equipment and grab branches and/or tree steps on the way down, thus making the use of a flashlight near impossible. As will be described in full detail hereafter, the features of my invention overcome these problems by providing a limited visual locating feature which makes the task of climbing out of a tree in relatively darkened conditions easier and much safer.

These and other types of tree and pole climbing devices disclosed in the prior art do not offer the flexibility and inventive features of my luminated Climbing Device For Trees And The Like. As will be described in greater detail hereinafter, the features and improvements of the present invention differ from those previously proposed.

SUMMARY OF THE INVENTION

According to my present invention I have provided, in the preferred embodiment the combination of a vertical structure to be climbed such as a tree and a pole and a metal step like climbing device. The metal step like climbing device includes an elongated threaded attaching structure for attaching the metal step like climbing device to the vertical structure. A surface engageable portion is connected to the elongated threaded attaching structure and extends perpendicularly in a downward direction therefrom. A step is connected to the surface engaging portion and extends perpendicularly thereto in a direction away from the attaching structure. An upturned outer end is connected to the step and extends perpendicularly thereto. A chamber is located at the outer end. My invention further includes luminescent means for radiating light. The chamber is sized to house the luminescent means and the luminescent means is housed in the chamber. An annular lip of opaque material encircles the luminescent means for limiting the radiating light to a substantially vertical direction of travel away from the chamber. Finally, a rigid transparent cover structure covers the chamber and protects the luminescent means from an outside environment.

Another feature of my invention relates to an alternative embodiment of my invention in a climbing device for climbing a vertical structure such as a tree and a pole. The climbing device including an attaching structure, a surface engageable portion connected to the attaching structure, a step connected to the surface engageable portion and the step having an outer end. The improvement of my device comprises a chamber at the outer end, luminescent means for radiating light, the chamber sized to house the luminescent means and the luminescent means being located in the chamber. My invention further includes opaque means for limiting the radiating light to a substantially vertical direction of travel away from the chamber and an at least semi-rigid and at least semi-transparent cover structure covering the chamber and protecting the luminescent means from an outside environment.

Still another feature of my invention concerns yet another possible embodiment where a tree step for climbing a vertical structure such as a tree and a pole in a relatively enlightened environment and then descending said vertical structure in a relatively darkened environment. This embodiment comprises an attaching structure. A surface engageable portion is connected to the attaching structure. A step is connected to the surface engageable portion. The step has an outer end. A sized chamber is located at the outer end. Luminescent means for radiating light is located in the sized chamber. Opaque means for limiting the radiating light to a substantially vertical direction of travel away from the chamber. And, an at least semi-rigid and at least semi-transparent cover structure covering the chamber and protecting the luminescent means from an outside environment.

According to important features of my invention I have also provided the luminescent means comprising a luminescent material encapsulated in a rigid transparent shell.

Yet another feature of my invention I have provided is the shell having a top portion. A rigid transparent cover structure comprising the top portion of the shell. And, the shell completely encapsulating the luminescent material in a continuous layer of clear plastic resin like material.

According to still further features of my invention I have also provided a rubber like coating covering a substantial portion of the climbing device. The elongated threaded attaching structure, the surface engageable portion, the step and the upturned outer end are all integrally constructed of a hardened metal. And, the luminescent means being permanently housed in the chamber, thereby providing an integrally connected climbing device.

Still another feature of my invention concerns a chamber housing removably mounted in a secure relationship to the outer end of the climbing device and the chamber being located in the chamber housing.

Yet another feature of my invention is the opaque means comprising the chamber housing being constructed of an opaque material from the group consisting of metal, plastic and synthetic plastic. The chamber includes a bottom, a top, and perimeter wall extending between the bottom and the top. And, the opaque material provides the perimeter wall and the bottom with an opaque characteristic that completely prevents the radiant light from passing through the perimeter wall and the bottom to the outside environment.

According to still further features of my invention I have provided the tree step comprising the surface engageable portion, the step, the sized chamber, the luminescent means, and the opaque means all being integrally constructed of a rigid material. The sized chamber includes a bottom, a top, and perimeter wall extending between the bottom and the top. And, the opaque means comprises the perimeter wall and the bottom having an opaque characteristic that completely prevents the radiant light from passing through the perimeter wall and the bottom to the outside environment.

Other objects, features and advantages of my invention will become more readily apparent upon reference to the following description when taken in conjunction with the accompanying drawings, which drawings illustrate several embodiments of my invention.

DESCRIPTION OF THE DRAWINGS

FIG. 4 is a partially enlarged cut away side view of an outer end of the climbing device shown in FIG. 1;

FIG. 5 is a partially enlarged cut away side view of an outer end and chamber housing of an alternative embodiment of my climbing device shown in FIG. 1;

FIG. 5*a* is top view of the climbing device shown in FIG. 5;

FIG. 6 is a partially enlarged cut away side view of an outer end and chamber housing of another embodiment of my climbing device shown in FIG. 1;

FIG. 6*a* is top view of the climbing device shown in FIG. 6;

FIG. 7 is a perspective view of yet another embodiment of my climbing device in accordance with teachings of my invention, here employing a nail like attaching structure;

FIG. 8 is a perspective view of yet another embodiment of my climbing device in accordance with teachings of my invention, here employing a bolt like attaching structure; and, FIG. 9 is a perspective view of yet another embodiment of my climbing device in accordance with teachings of my invention, here employing a belt like attaching structure.

DETAILED DESCRIPTION OF THE PREFERRED EMBODIMENT

Figure 1:
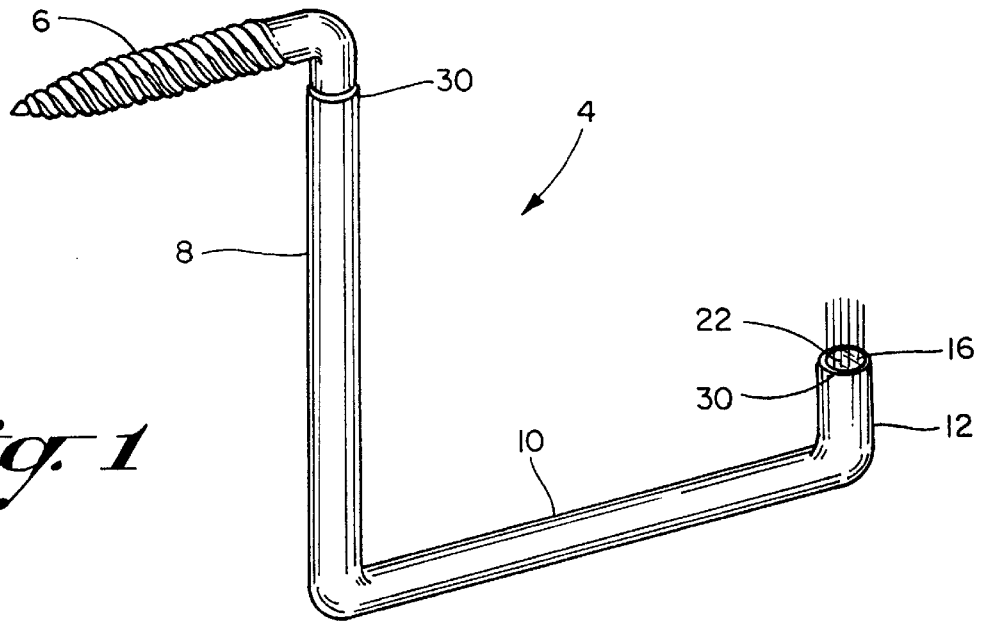
FIG. 1 is a perspective view of my climbing device or tree step in accordance with the preferred embodiment of my invention.
Figure 2:
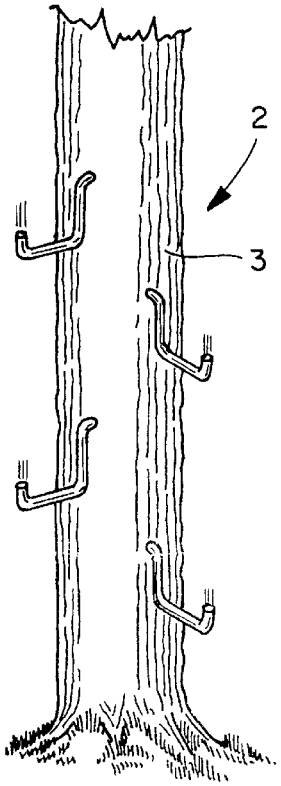
FIG. 2 is a reduced view of the climbing device shown in FIG. 1, here with multiple climbing devices attached to a vertical structure.
Figure 3:
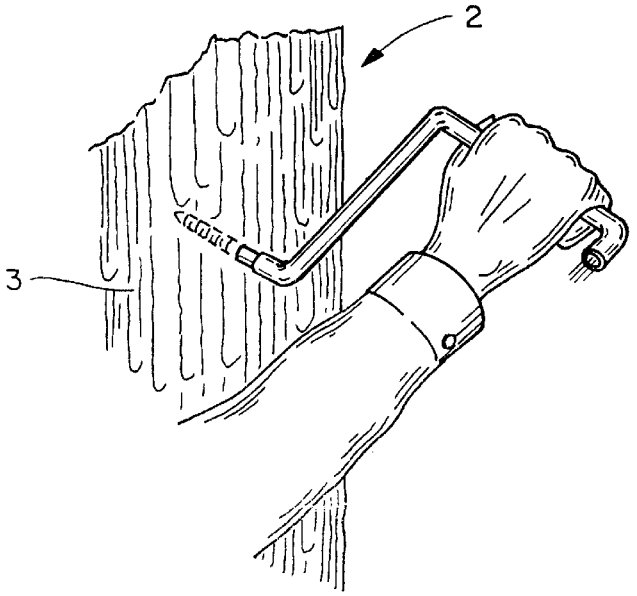
FIG. 3 is a reduced view of the climbing device in FIG. 1, here showing the manual attachment of my invention to a vertical structure.

Referring now to the drawings, FIG. 1 shows my new and improved step like climbing device or climbing device or tree step 4. The climbing device 4 includes an elongated threaded attaching structure or attaching structure 6 for attaching the climbing device to a vertical structure 2 to be climbed such as a tree 3 and a pole (not specifically shown). Excellent results are obtained when the attaching structure 6 comprises an elongated threaded screw like structure as shown in FIG. 1. However, alternative embodiments of my invention may employ a nail like structure 40, a removable bolt like structure 42 or a removable belt like structure 44, as shown respectively in FIGS. 7, 8 and 9, and still remain within the disclosed and claimed scope of my invention.

A surface engageable portion 8 is connected to the attaching structure 6 and extends perpendicularly in a downward direction therefrom. A step 10 is connected to the surface engaging portion and extends perpendicularly thereto in a direction away from the attaching structure 6. An upturned outer end or outer end 12 is connected to the step and extends perpendicularly thereto.

Next, there is a chamber 14 located at the outer end 12. The chamber is sized to house a luminescent material 24. The luminescent material provides radiating light therefrom. Excellent results are obtained when the luminescent material comprises a powder (to be mixed with some other material to protect it from the environment) and the luminescent material is self regenerating through exposure to a member from the group consisting of natural light and artificial light. At present, it is contemplated that the luminescent material be that sold under the trademark "LUMINOVA"(™) by Nemoto Company of Tokyo, Japan, which is distributed in the U.S. by United Mineral And Chemical Company of N.J.

An annular lip 16 of opaque material encircles the luminescent material. The lip serves to limit the radiating light to a substantially vertical direction of travel away from the chamber. The feature of limiting the light radiating from the luminescent material (obtainable through the lip 16 and other structure as discussed in detail hereafter) is critical to the practice of my invention. In particular, the light is intended to be viewable only from a position over looking the climbing device where the radiating light essentially just glows by radiating light only a very short distance which does not illuminate other structures such as tree branches and the like located above the attached climbing device. Also in this way, other individuals on the ground cannot readily see the climbing device. Then, a cover structure 22 covers the chamber 14 and protects the luminescent material from an outside environment, such as weather elements and ones foot that steps onto the climbing device when being used.

In the preferred embodiment of my invention as shown in FIG. 1, a rubber like coating 30 covers a substantial portion of the climbing device 4. Further excellent results are obtained when the attaching structure 6, the surface engageable portion 8, the step 10 and the outer end 12 are all integrally constructed of a solid rod shaped hardened metal and the luminescent material is permanently housed in the chamber, thereby providing an integrally connected climbing device 4. Additionally, excellent results are obtained when the luminescent material is encapsulated in a rigid transparent shell 26. In particular, this shell 26 includes a top portion 28, the cover structure 22 is rigid and transparent and comprises the top portion of the shell. Further, the shell completely encapsulates the luminescent material in a continuous layer of clear plastic resin like material thereby forming the shell and the cover structure as one integrally connected layer encapsulating the luminescent material. At present, it is preferred that the clear plastic resin be that sold under the trademark "CASTOLITE-AC"(TM) by Castolite Company of Woodstock, Ill., and known as clear casting plastic.

In alternative embodiments of my invention shown in FIGS. 5 through 6 inclusive, it is preferred that the climbing device 4 comprising the attaching structure 6, the surface engageable portion 8, the step 10 and the outer end 12 are all integrally constructed of a solid rod shaped hardened metal material. Additionally, it is preferred that a rubber like coating 30 cover a substantial portion of the climbing device to provide a non-slip surface to at least the step of the climbing device.

As shown in FIGS. 5 through 6 inclusive, a chamber housing 32 can be removably mounted in a secure relationship to the outer end 12 of the climbing device (preferably utilizing an existing climbing device, such as those shown in the prior art cited herein, thus eliminating the need for any structural modification before being equipped with means for luminating the existing climbing device), where the chamber 14 is located in the chamber housing. Further for these embodiments the chamber housing 32 is preferably constructed of an opaque material from the group consisting of metal, plastic and synthetic plastic. Then, the chamber 14 includes a bottom 34, a top 36, and a perimeter wall 3 8 extending between the bottom and the top where the opaque material provides the perimeter wall and the bottom with an opaque characteristic that completely prevents the radiant light from passing through the perimeter wall and the bottom to the outside environment.

In further alternative embodiments of my invention shown in FIGS. 7 through 9 inclusive, it is preferred that the climbing device 4 comprising the attaching structure 6, the surface engageable portion 8, the step 10 and the outer end 12 are all integrally constructed of a rigid material, namely, an opaque material from the group consisting of metal, plastic and synthetic plastic. Additionally, it is preferred that a tread 46 cover a substantial portion of the step of the climbing device to provide a non-slip surface.

As shown in phantom in FIG. 7 (and applicable though not specifically shown in FIGS. 8 and 9), the chamber 14 includes a bottom 34, a top 36, and a perimeter wall 38 extending between the bottom and the top. Here, the opaque material provides the perimeter wall and the bottom with an opaque characteristic that completely prevents the radiant light from passing through the perimeter wall and the bottom to the outside environment.

At the present time the preferable way to construct my invention comprises the following steps. First, providing an existing climbing device or tree step 4. Then, sizing a chamber 14 in the outer end 12 by appropriate means known in the prior art, such as boring with a drill bit. Third, one should mixing a clear plastic resin or clear casting compound with a powered luminescent material (to protect it from the environment). Next, this mixture is dripped into the chamber, where the climbing device must be maintained in an upright position until the construction process is complete. Fifth, the mixture is allowed a sufficient time to cure in the chamber thereby effectively permanently securing the shell and luminescent material in the chamber. Further, during the curing step the luminescent powder automatically collects in the center of the mixture leaving a rigid transparent continuous layer of clear plastic resin shell surrounding the luminescent material.

Although at the present time the preferable way to construct my invention comprises the above steps, it is contemplated that in a large scale manufacturing setting it will be preferable to make the climbing device 4 comprising the attaching structure 6, the surface engageable portion 8, the step 10, the chamber 14 and the chamber housing 32 from raw materials. Thereafter, mixing the clear plastic resin or clear casting compound with a powered luminescent material and continuing with the applicable steps to complete the construction of my invention.

It should be understood that other structures have been experimented with to provide the lumination or illumination for my invention here, such as battery operated lighting or a treatium light source. However, testing and experimentation has proven these to be near inoperable and vastly inferior to the operation of my invention disclosed and claimed here. This does not mean, however, that despite these inferior results such other structures could be utilized with my invention and they would fall outside the scope of my invention. Rather, it is contemplated that such other structures utilized with my invention would fall within the broad scope of my invention, though the other structures may embody additional improvements that go beyond the scope of my invention.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. In combination, a vertical structure to be climbed and a metal step like climbing device, the metal step like climbing device including an elongated threaded attaching structure for attaching the metal step like climbing device to the vertical structure, a surface engageable portion connected to the elongated threaded attaching structure and extending perpendicularly in a downward direction therefrom, a step connected to the surface engaging portion and extending perpendicularly thereto and in a direction away from the attaching structure, an upturned outer end connected to the step and extending perpendicularly thereto, a chamber at the outer end, luminescent means for radiating light, the chamber sized to house the luninesecent means, the luminescent means being housed in the chamber, an annular lip of opaque material encircling a top portion of the luminescent means for limiting the radiating light to a substantially vertical direction of travel away from the chamber, a rigid transparent cover structure covering the chamber and protecting the luminescent means from an outside environment.

2. The combination of claim 1, wherein the luminescent means comprises a luminescent material encapsulated in a rigid transparent shell.

3. The combination of claim 2, wherein the shell comprises a clear plastic resin like material.

4. The combination of claim 2, wherein the luminescent material initially comprises a powder form, said luminescent material being self regenerating through exposure to a member from a group consisting of natural light and artificial light.

5. The combination of claim 2, wherein the shell has a top part, the rigid transparent cover structure comprises the top part of the shell, and the shell completely encapsulates the luminescent material in a continuous layer of clear plastic resin like material.

6. The combination of claim 5, wherein a rubber like coating covers a substantial portion of the metal step like climbing device, and further the elongated threaded attaching structure, the surface engageable portion, the step and the upturned outer end are all integrally constructed of a hardened metal, and further the luminescent means is permanently housed in the chamber, thereby providing an integrally connected step like climbing device.

7. In a climbing device for climbing a vertical structure, said climbing device including an attaching structure, a surface engageable portion connected to the attaching structure, a step connected to the surface engageable portion and the step having an outer end, the improvement comprising:

a chamber at the outer end;

luminescent means for radiating light;

the chamber sized to house the luminescent means:

the luminescent means being located in the chamber;

opaque means for limiting the radiating light to a substantially vertical direction away from the chamber; and an at least semi-rigid and at least semi-transparent cover structure covering the chamber and protecting the luminescent means from an outside environment.

8. The climbing device of claim 7, wherein the luminescent means comprises a luminescent material encapsulated in a rigid transparent shell.

9. The climbing device of claim 8, wherein the shell has a top portion, the at least semi-rigid and at least semi-transparent cover structure comprises the top portion of the shell, and the shell completely encapsulates the luminescent material in a continuous layer of clear plastic material.

10. The climbing device of claim 9, wherein the chamber has an annular lip and the top portion of the shell being substantially co-extensive with the annular lip.

11. The climbing device of claim 8, wherein the luminescent material initially comprises a powder form, said luminescent material being self regenerating through exposure to a member from a group consisting of natural light and artificial light.

12. The climbing device of claim 7, wherein the climbing device comprising the attaching structure, the surface engageable portion, the step and the outer end are all integrally constructed of a rigid metal material, a rubber like coating covering a substantial portion of the climbing device, a chamber housing removably mounted in a secure relationship to the outer end of the climbing device, and the chamber being located in the chamber housing.

13. The climbing device of claim 12, wherein the opaque means comprises the chamber housing being constructed of an opaque material from a group consisting of metal, plastic and synthetic plastic, said chamber including a bottom, a top, and a perimeter wall extending between the bottom and the top, said opaque material providing the perimeter wall and the bottom with an opaque characteristic that completely prevents the radiant light from passing through the perimeter wall and the bottom to the outside environment.

14. A tree step for climbing a vertical structure in a relatively enlightened environment and then descending said vertical structure in a relatively darkened environment, comprising:

an attaching structure;

a surface engageable portion connected to the attaching structure;

a step connected to the surface engageable portion;

the step having an outer end;

a sized chamber at the outer end;

luminescent means for radiating light, said luminescent means located in the sized chamber;

opaque means for limiting the radiating light to a substantially vertical direction of travel away from the chamber; and, an at least semi-rigid and at least semi-transparent cover structure covering the chamber and protecting the luminescent means from an outside environment.

15. The tree step of claim 14, wherein the tree step comprising the surface engageable portion, the step, the sized chamber, the luminescent means, and the opaque means are all integrally constructed of a rigid material, the sized chamber includes a bottom, a top, and a perimeter wall extending between the bottom and the top, and the opaque means comprises the perimeter wall and the bottom having an opaque characteristic that completely prevents the radiant light from passing through the perimeter wall and the bottom to the outside environment.

16. The tree step of claim 15, wherein the luminescent means comprises a luminescent material encapsulated in a rigid transparent shell and the shell comprises a clear plastic resin like material.

17. The tree step of claim 16, wherein the shell has a top portion, the at least semi-rigid and at least semi-transparent cover structure comprises the top portion of the shell, and the shell completely encapsulates the luminescent material in a continuous layer of clear plastic material.

18. The tree step of claim 17, wherein the luminescent material is self regenerating through exposure to a member from a group consisting of natural light and artificial light.

19. The tree step of claim 14, wherein the tree step comprising the attaching structure, the surface engageable portion, the step and the outer end are all integrally constructed of a rigid metal material, a rubber like coating covering a substantial portion of the tree step, a chamber housing removably mountable in a secure relationship to the outer end of the tree step, and the sized chamber being located in the chamber housing.

20. A tree step for climbing a vertical structure in a relatively enlightened environment and then descending the vertical structure in a relatively darkened environment comprising:

an attaching structure;

a surface engageable portion connected to the attaching structure;

a step connected to the surface engageable portion and having an upwardly facing step surface;

the step having an outer end;

luminescent means for radiating light, said luminescent means located at the outer end along said upwardly facing step surface, and said luminescent means comprising a luminescent member positioned for projecting light only in an upward direction from the upwardly facing step surface but radiating light emitted from the luminescent member being hidden when viewed from all other directions; and an at least semi-rigid and at least semi-transparent cover structure covering the luminescent member and protecting the luminescent member from an outside environment.

* * * * *